United States Patent [19]

Moser et al.

[11] 4,068,806

[45] Jan. 17, 1978

[54] BOBBIN TUBE CLAMPING DEVICE

[75] Inventors: Louis Moser, Hettlingen; Albert Rüegg, Pfaffikon, both of Switzerland

[73] Assignee: Rieter Machine Works Ltd., Winterthur, Switzerland

[21] Appl. No.: 659,325

[22] Filed: Feb. 19, 1976

[30] Foreign Application Priority Data

Mar. 14, 1975 Switzerland ..... 3241/75

[51] Int. Cl.[2] ..... B65H 75/30; B65H 79/00

[52] U.S. Cl. ..... 242/46.4

[58] Field of Search ..... 242/46.4, 46.2, 46.3, 242/46.5, 46.6, 68.2, 68.3, 72 R, 72.1

[56] References Cited

U.S. PATENT DOCUMENTS

| | | | |
|---|---|---|---|
| 1,192,063 | 7/1916 | Hoberg | 242/46.3 X |
| 3,052,420 | 9/1962 | Roberts | 242/46.3 |
| 3,593,934 | 7/1971 | Conrad et al. | 242/46.5 |

FOREIGN PATENT DOCUMENTS

| | | | |
|---|---|---|---|
| 1,558,065 | 1/1969 | France | 242/46.2 |
| 304,752 | 1/1933 | Italy | 242/46.6 |

*Primary Examiner*—Stanley N. Gilreath
*Attorney, Agent, or Firm*—Werner W. Kleeman

[57] ABSTRACT

A bobbin tube clamping device for a bobbin chuck for textile bobbins comprising a tubular sleeve member for supporting the textile bobbin tube and a chuck member movable within the sleeve member in the axial direction of the bobbin chuck. The bobbin chuck contains at least three openings extending substantially in the axial direction of the lengthwise axis of the bobbin chuck. Each opening is provided with at least two guide surfaces for guiding an associated bobbin tube clamping element. The portion of the bobbin tube clamping element which is guided by the associated opening is substantially segment shaped at least at its end protruding from the bobbin chuck and the oppositely situated parallel surfaces or walls of such segment-shaped end of the bobbin tube clamping element slidingly contact the guide surface of the associated opening. Each bobbin tube clamping element following the portion thereof which slidingly contacts the guide surfaces is provided with an enlarged gliding portion extending into the interior of the tubular sleeve member and protruding past the parallel walls of the segment-shaped portion thereof.

5 Claims, 4 Drawing Figures

Fig.1
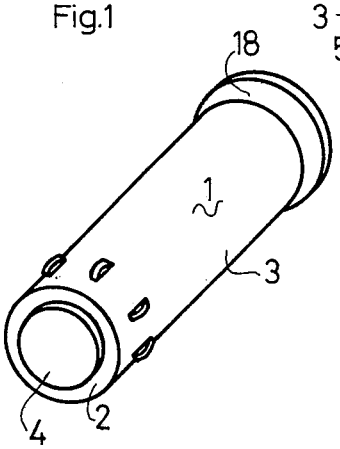
Fig.2
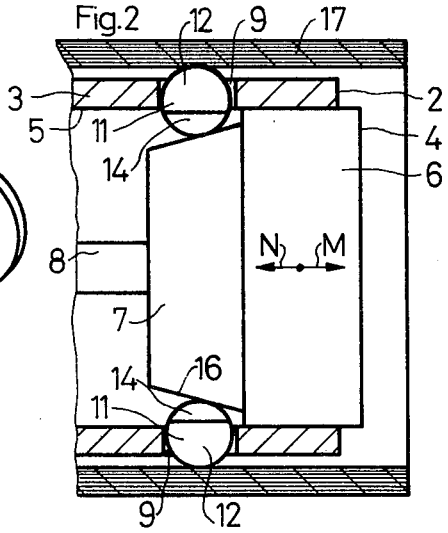
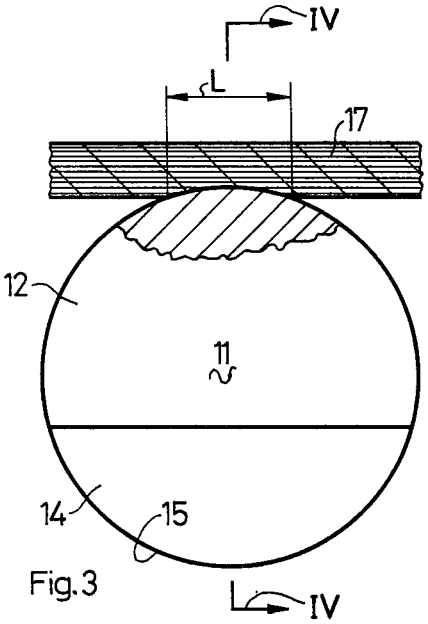
Fig.3
Fig.4
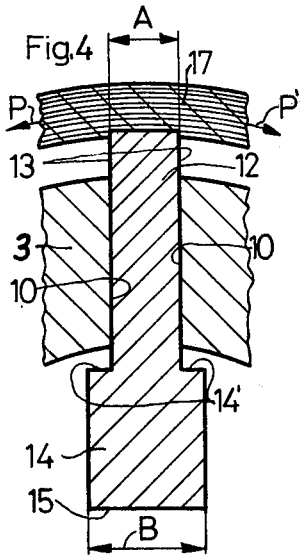

BOBBIN TUBE CLAMPING DEVICE

BACKGROUND OF THE INVENTION

The present invention relates to a new and improved construction of bobbin tube clamping device for a bobbin chuck for textile bobbins.

Generally speaking, the arrangement of the invention is of the type incorporating a tubular sleeve member for supporting the textile bobbin tube, a chuck member is arranged to be movable within the sleeve member in the axial direction of the bobbin chuck. The chuck member has a guide surface inclined with regard to the lengthwise axis of the bobbin chuck for supporting and displacing in a direction radially of the bobbin chuck a tube clamping element partially protruding to a limited extent through an opening of the tubular sleeve member. Bobbin tube clamping devices of the aforementioned type and others are used primarily in conjunction with winding machines serving to wind endless filaments or the like.

This particular field of technology is already acquainted with different constructions of bobbin tube clamping devices employing tube clamping elements capable of moving radially with respect to the bobbin chuck for the purpose of clamping a bobbin tube which has been placed on to the bobbin chuck.

One state-of-the-art construction teaches the provision of a circular body provided with a circumferential groove for receiving a number of balls, the circular body being slidably arranged in a bobbin chuck having a tubular sleeve member. The groove is formed by two conical surfaces which are differently inclined with respect to the bobbin chuck axis. The surface of less inclination serves as a sliding surface upon which the balls —during axial movement of the circular body — are moved partially through openings in the sleeve member in such a manner that the balls are pressed in the radial direction with respect to the bobbin chuck against the inner wall of a bobbin tube placed upon the bobbin chuck. In order to prevent the balls from passing through the openings, the openings are adapted in spherical configuration to the ball surface.

A decisive drawback of this state-of-the-art device resides in the fact that the balls must be pressed with considerable force against the inner wall of the bobbin tube in order to be able to take-up the braking moment of a heavy and rapidly rotating full bobbin package, which, as should be evident, either causes undesirable deformations of the bobbin tube or requires considerably stronger and thus more expensive bobbin tubes.

A further drawback resides in the fact that the spherical guide zone prevents rotation of the balls during the time that the bobbin package is braked substantially only by the action of the friction between the ball surface and the guide zone, which also requires high contact pressures and results in a protrusion or departure of the balls which is limited by the openings.

Additionally, the manufacture of such spherical-shaped openings which are provided in such arrangement is both complicated and expensive.

SUMMARY OF THE INVENTION

Hence, with the foregoing in mind it is a primary object of the present invention to provide an improved construction of bobbin tube clamping device which is not associated with the aforementioned drawbacks and limitations of the prior art proposals.

Another and more specific object of the present invention aims at eliminating the aforementioned disadvantages and devising a bobbin tube clamping device by means of which it is possible to securely guide the bobbin tubes without the need for applying great force, the bobbin tubes are secured against rotation relative to the bobbin chuck and are easily and positively removable from the bobbin chuck.

Yet a further significant object of the present invention aims at a novel construction of bobbin tube clamping device coacting with a bobbin tube which is to be clamped on the bobbin chuck in a manner insuring for positive engagement of the bobbin tube without exerting any forces which would tend to damage or destroy the bobbin tube while still allowing for easy and safe handling of the bobbin tubes including doffing and donning thereof.

Now in order to implement these and still further objects of the invention, which will become more readily apparent as the description proceeds, the bobbin tube clamping device on or for a bobbin chuck for textile bobbin tubes as contemplated by the invention has at least three openings provided for the bobbin chuck, the openings extending angularly about the bobbin chuck and substantially in the axial direction of the lengthwise axis of the bobbin chuck. These openings can be configured so as to possess corners and are provided with at least two guide surfaces for guiding an associated bobbin tube clamping element. The portion of the bobbin tube clamping element intended to be guided by an associated opening is substantially segment-shaped at least at its end protruding from the bobbin chuck. Oppositely situated substantially parallel surfaces or walls of the segment-shaped end or portion of the bobbin tube clamping element slidingly contact the guide surfaces of the associated opening. Each such bobbin tube clamping element is provided with an enlarged gliding portion or member contacting the inclined guide surface of the chuck member and extending into the interior of the tubular sleeve member of the bobbin chuck. This enlarged gliding member is larger in size than the spacing between the parallel walls of the segment-shaped end or portion of the bobbin tube clamping element and possesses projection or protrusion means.

With the arrangement contemplated by the invention it is possible for the segment-shaped portion to be a disk section of a substantially cylindrical body. Moreover, the edges formed by the faces or parallel surfaces of the disk section can be sharp. Also the guide surfaces of the openings and the opposed parallel surfaces of the segment-shaped portion can be mutually parallel.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a perspective, semi-schematic view of a bobbin chuck but without a bobbin tube being shown supported thereon;

FIG. 2 is a fragmentary longitudinal sectional view through the free end of the bobbin chuck onto which there has been mounted a bobbin tube and clamped by bobbin tube clamping elements;

FIG. 3 is an enlarged view of one of the bobbin tube clamping elements of the arrangement of FIG. 2; and FIG. 4 is a cross-sectional view of the bobbin tube clamping element shown in FIG. 3, taken substantially along the line IV—IV thereof.

DETAILED DESCRIPTION OF THE PREFERRED EMBODIMENTS

Describing now the drawings, a chuck member 4 is movably inserted into the end 2 of a tubular sleeve member 3 of a bobbin chuck 1 (FIG. 1) supported by a not particularly illustrated machine frame. The chuck member 4 is movable in the axial direction of the bobbin chuck 1. This chuck member 4 comprises a substantially cylindrical portion 6 guided on the inner or inside wall 5 of the tubular sleeve member 3 and a substantially conical portion or cone 7 confronting the internal space or inside room of the bobbin chuck 1. Operatively connected with the cone or conical portion 7 is a piston rod 8 for axially moving the chuck member 4 back and forth. This piston rod 8 constitutes a drive member for the chuck member 4 and in turn is connected with any suitable drive means (not shown) in order to generate the requisite to-and-fro motion.

The sleeve member 3 is provided with openings 9, for instance of rectangular configuration, each opening 9 having a pair of guide surfaces 10 which are essentially parallel to one another and extend in the axial direction of the bobbin chuck 1.

Further, the invention contemplates the provision of bobbin tube clamping elements 11 each of which consist of a substantially segment-shaped portion 12 having two mutually parallel surfaces or walls 13. The distance or spacing A of these parallel surfaces 13 is selected such that the segment-shaped portion 12 can be slidingly guided by the mutually parallel surfaces 13 at the guide surfaces 10 of the associated opening or recess 9. Each such segment-shaped portion 12 is connected to a gliding portion 14. The width B of the gliding portion 14 exceeds the distance A in such a manner that there are formed two projections or protrusions 14' which exceed such distance A, these projections or protrusions 14' limiting the penetration of the bobbin tube clamping element 11 through the associated opening 9.

The gliding portion 14 with its gliding surface 15 contacts the conical guide surface 16 of the cone or conical portion 7.

During operation, the chuck member 4, prior to the time that a bobbin tube 17 is donned, is moved in the direction designated by the arrow M of FIG. 2 in such a manner that the bobbin tube clamping elements 11 are moved towards the inside, that is to say, radially inwardly, to such an extent that the bobbin tube 17 can be displaced over the bobbin tube clamping elements 11 without any appreciable resistance so as to bear against a stop 18 provided on the bobbin chuck 1. Thereafter, the chuck member 4 is again moved back in the direction of the arrow of FIG. 2 designated by reference character N to such an extent that the bobbin tube clamping elements 11 hold the bobbin tube clamped with a predetermined radial contact pressure. Such predetermined contact or contacting pressure can be generated in that, for instance, a drive in the form of a pneumatic cylinder which is connected with the piston rod 8 is supplied with a pressurized fluid medium which generates the desired contact pressure, or else such contact pressure can be realized by the provision of a pre-tensioned spring (not shown) which acts upon the piston rod 8 in the direction of the arrow N. Any suitable means can be employed for shifting the piston rod 8 as explained above. In order to release the contact pressure the piston rod 8 is correspondingly moved in the direction of the arrow M in such a manner that the bobbin tube 17 can be doffed.

One of the main advantages of the invention resides in the fact that due to the substantially segment-shape of the portions 12 there is realized an advantageous ratio of the specific pressure and contact force over the length L in such a manner that even with relatively low contact pressure each portion 12 digs into the bobbin tube over the length L and there is thus established a fixation of the bobbin tube 17 on the bobbin chuck which is capable of withstanding a braking moment generated by a force P or P' (FIG. 4) respectively.

Furthermore, there is present the possibility of reducing the mass of such bobbin tube clamping elements by providing them with bores without impairing the guiding capabilities of the bobbin tube clamping elements in the rectangular openings, something which is not possible if there is used a ball due to its indeterminable position in the spherical guide zone and due to the thus resulting non-uniform imbalance of the high-speed rotating bobbin chuck.

While there are shown and described present preferred embodiments of the invention, it is to be distinctly understood that the invention is not limited thereto, but may be otherwise variously embodied and practiced within the scope of the following claims.

Accordingly, what is claimed is:

1. A bobbin tube clamping device for a bobbin chuck for textile bobbins, comprising a substantially hollow tubular sleeve member for supporting textile bobbin tubes, a chuck member mounted to be movable within the tubular sleeve member in the axial direction thereof, bobbin tube clamping elements cooperating with said chuck member, said chuck member being provided with a guide surface which is inclined with respect to the lengthwise axis of the chuck member for supporting and moving said bobbin tube clamping elements in a radial direction, said tubular sleeve member being provided with at least three openings extending substantially in the axial direction of the tubular sleeve member, each axially extending opening being provided with at least two guide surfaces extending substantially in the axial direction of the tubular sleeve member for guiding an associated bobbin tube clamping element, each said bobbin tube clamping element having a portion guided by the two axially extending guide surfaces of the associated opening, said guided portion having a substantially arcuate end protruding from the tubular sleeve member, the axis of the radius of curvature of said arcuate end extending substantially transversely of the axis of said tubular member, said guided portion having opposed substantially parallel walls which contact the two axially extending guide surfaces of the associated opening, each bobbin tube clamping element having a gliding portion extending into the interior of the tubular sleeve member and having projection means extending beyond the distance between the parallel walls of the guided portion of such bobbin tube clamping element.

2. The bobbin tube clamping element as defined in claim 1, wherein the guided portion comprises a disk-section of a substantially cylindrical body.

3. The bobbin tube clamping element as defined in claim 2, wherein said disk-section possesses edges formed by end faces of the guided portion and which edges are sharp.

4. The bobbin tube clamping element as defined in claim 1, wherein the guide surfaces of each opening and the opposed parallel walls of the guided portion of the associated bobbin tube clamping element are essentially parallel to one another.

5. An arrangement for chucking textile bobbin tubes, comprising a sleeve member for supporting textile bobbin tubes, a chuck member mounted to be movable within the sleeve member in its axial direction, bobbin tube clamping elements in contact with said chuck member, said chuck member being provided with a guide surface which is inclined with respect to the lengthwise axis of the chuck member for supporting and moving said bobbin tube clamping elements in a radial direction, said sleeve member having a plurality of openings, each opening being provided with at least two guide surfaces extending substantially in the axial direction of said sleeve member for guiding an associated bobbin tube clamping element, each said bobbin tube clamping element having a portion guided by the two guide surfaces of the associated opening and which portion is of substantially the shape of a segment of a cylinder, the axis of the cylindrical segment extending transversely of the axis of said sleeve member, each said guided portion having opposite substantially parallel surfaces which contact the axially extending guide surfaces of the associated opening, each bobbin tube clamping element having means for contacting the inclined guide surface of said chuck member for limiting the movement of the guided portion in its associated opening.

* * * * *